US009709946B2

(12) United States Patent
Tano et al.

(10) Patent No.: US 9,709,946 B2
(45) Date of Patent: Jul. 18, 2017

(54) CLEANING BLADE, PROCESS CARTRIDGE, AND IMAGE FORMING APPARATUS

(71) Applicant: FUJI XEROX CO., LTD., Tokyo (JP)

(72) Inventors: Daisuke Tano, Kanagawa (JP); Yu Nakamura, Kanagawa (JP); Noriaki Kojima, Kanagawa (JP); Kei Tanaka, Kanagawa (JP); Shintaro Kikuchi, Kanagawa (JP); Yuko Kawase, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/042,249

(22) Filed: Feb. 12, 2016

(65) Prior Publication Data

US 2017/0068206 A1 Mar. 9, 2017

(30) Foreign Application Priority Data

Sep. 4, 2015 (JP) ..... 2015-175111

(51) Int. Cl.
*G03G 21/00* (2006.01)
*G03G 21/18* (2006.01)

(52) U.S. Cl.
CPC ..... *G03G 21/0017* (2013.01); *G03G 21/1814* (2013.01)

(58) Field of Classification Search
CPC ..... G03G 21/0017
See application file for complete search history.

(56) References Cited

U.S. PATENT DOCUMENTS

| | | | | |
|---|---|---|---|---|
| 8,275,302 | B2 | 9/2012 | Sako et al. | |
| 2006/0216084 | A1* | 9/2006 | Kojima | G03G 21/0017 399/350 |
| 2014/0086656 | A1* | 3/2014 | Takahashi | G03G 21/0011 399/350 |

FOREIGN PATENT DOCUMENTS

| | | | |
|---|---|---|---|
| JP | 8-179669 | A | 7/1996 |
| JP | 2008-185716 | A | 8/2008 |

* cited by examiner

*Primary Examiner* — Clayton E Laballe
*Assistant Examiner* — Victor Berbitsky
(74) *Attorney, Agent, or Firm* — Sughrue Mion, PLLC

(57) ABSTRACT

A cleaning blade includes a polyurethane member that constitutes at least a contact portion that comes in contact with a member to be cleaned. The polyurethane member contains a polyurethane containing a hard segment component and a soft segment component. The hard segment component has a domain particle size of about 45 nm or more and about 100 nm or less.

10 Claims, 6 Drawing Sheets

CLEANING BLADE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-175111 filed Sep. 4, 2015.

BACKGROUND (i) Technical Field

The present invention relates to a cleaning blade, a process cartridge, and an image forming apparatus.

(ii) Related Art

Hitherto, in copying machines, printers, facsimiles, etc. using an electrophotographic system, a cleaning blade has been used as a cleaning tool for cleaning a surface of a member to be cleaned, such as an image-carrying member, by removing a remaining toner and the like.

SUMMARY

According to an aspect of the invention, there is provided a cleaning blade including a polyurethane member that constitutes at least a contact portion that comes in contact with a member to be cleaned, in which the polyurethane member contains a polyurethane containing a hard segment component and a soft segment component, and the hard segment component has a domain particle size of about 45 nm or more and about 100 nm or less.

BRIEF DESCRIPTION OF THE DRAWINGS

Exemplary embodiments of the present invention will be described in detail based on the following figures, wherein.

DETAILED DESCRIPTION

Figure 1:
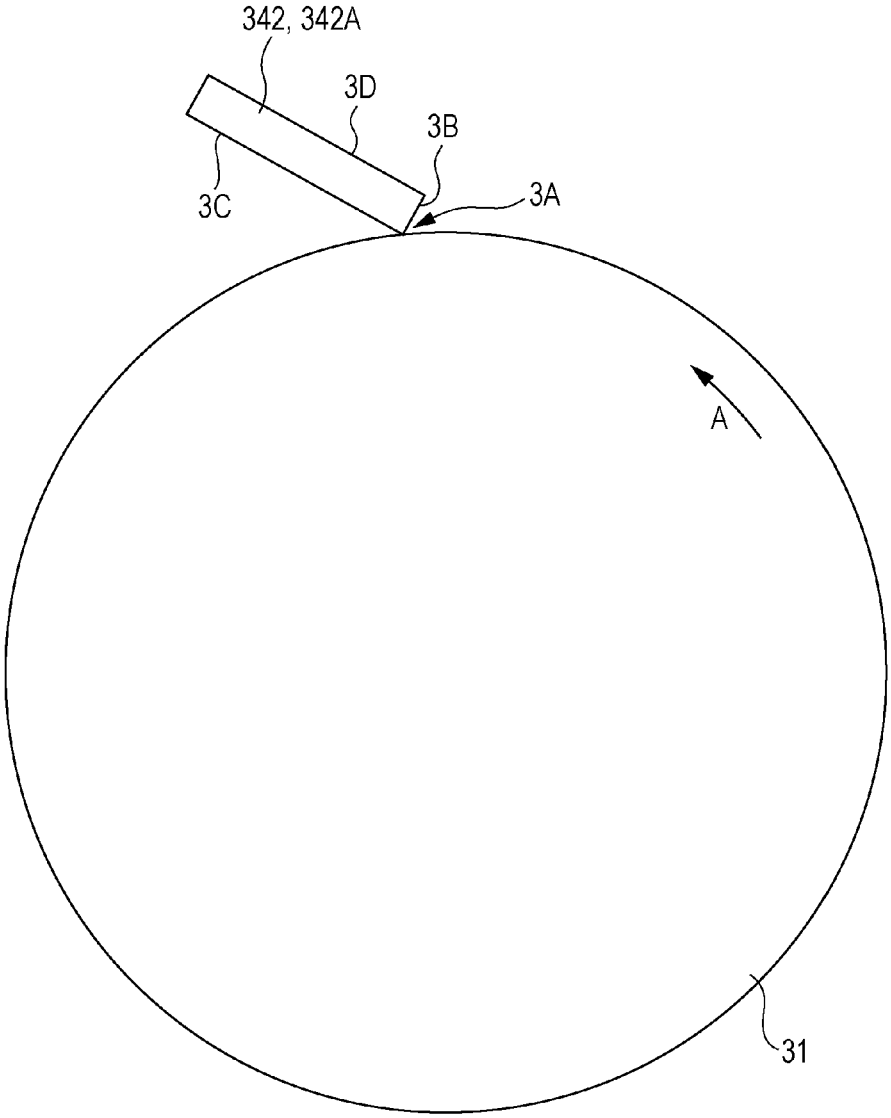
FIG. 1 is a schematic view illustrating an example of a cleaning blade according to an exemplary embodiment.

A cleaning blade, a cleaning device, a process cartridge, and an image forming apparatus according to exemplary embodiments of the invention will now be described in detail.

Cleaning Blade

A cleaning blade according to an exemplary embodiment includes a polyurethane member that contains a polyurethane containing a hard segment component (H phase) and a soft segment component (S phase), the polyurethane member constituting at least a contact portion that comes in contact with a member to be cleaned.

The hard segment component has a domain particle size of 45 nm or more and 100 nm or less or about 45 nm or more and about 100 nm or less.

Hitherto, in electrophotographic image forming apparatuses such as a copying machine, a printer, and a facsimile, a cleaning blade has been used as a cleaning tool for removing foreign substances such as a toner remaining on a surface of an image-carrying member. Since a cleaning blade is usually brought into contact with a member to be cleaned, such as an image-carrying member, for a long time, permanent deformation may occur in a portion that comes in contact with the member to be cleaned. This permanent deformation occurs more significantly in a higher temperature environment. When permanent deformation occurs in the cleaning blade, a pressure for pressing the member to be cleaned changes and is out of a desired range of the pressing pressure. As a result, foreign substances such as a remaining toner and an external additive easily pass through a gap between the member to be cleaned and the cleaning blade.

In particular, in electrophotographic image forming apparatuses that use a toner, the reduction in a toner size and the realization of a spherical toner have been desired in recent years. Accordingly, the passing through of a remaining toner may occur more easily in a contact portion between a member to be cleaned and a cleaning blade. The occurrence of the passing through of foreign substances such as a remaining toner and an external additive may result in streak-like image defects in an image forming apparatus.

In view of this, in the cleaning blade according to the exemplary embodiment, since the domain particle size of the hard segment component of a polyurethane is in the above range, the occurrence of permanent deformation is reduced as compared with a case where the domain particle size exceeds 100 nm or about 100 nm.

The reason why this effect is achieved is not clear but is believed to be as follows. By decreasing the domain particle size of the hard segment component (H phase) of the polyurethane to 100 nm or less or about 100 nm or less, the glass transition temperature (Tg) becomes lower than that in the case where the domain particle size exceeds 100 nm or about 100 nm, the molecular motion becomes active to suppress plastic deformation, and the generation of permanent deformation is reduced.

Domain Particle Size of Hard Segment Component

The above polyurethane has a structure in which a hard segment component and a soft segment component in the molecular structure form a sea-island structure, and aggregates (islands) of the hard segment component are dispersed in the soft segment component (sea). A particle size of the hard segment that forms an island is referred to as "domain particle size".

The domain particle size of the hard segment component is 45 nm or more and 100 nm or less, or about 45 nm or more and about 100 nm or less, preferably 45 nm or more and 90 nm or less, or about 45 nm or more and about 90 nm or less, and more preferably 45 nm or more and 80 nm or less, or about 45 nm or more and about 80 nm or less.

When the domain particle size exceeds 100 nm or about 100 nm, the cohesive force in the domain of the hard segment component (H phase) is weakened, and permanent deformation may occur in the cleaning blade. When the domain particle size is less than 45 nm or about 45 nm, it may be difficult to obtain the strength necessary for the cleaning blade.

Herein, the domain particle size of the hard segment component (H phase) is calculated by atomic force microscopy (AFM). Specifically, an image of a cross section of a polyurethane member is observed with an atomic force microscope (AFM, manufactured by Hitachi High-Tech Science Corporation, product name: S-image/NanoNavi 2), and 50 domains of the hard segment component (H phase) in the image are selected. The diameters of the longest portions of the domains are measured, and the average thereof is calculated. This observation is conducted in three cross sections, and the average of the three sections is determined as the domain particle size.

An example of a method for controlling the domain particle size of the hard segment component (H phase) is a method for adjusting the polarities of the hard segment component (H phase) and the soft segment component (S phase). For example, with an increase in the polarity of the hard segment component (H phase) and with a decrease in the polarity of the soft segment component (S phase), the domain particle size of the hard segment component becomes smaller. The domain particle size of the H phase may be controlled by adjusting the polarities of both the hard segment component (H phase) and the soft segment component (S phase).

The method for adjusting the polarities of the hard segment component (H phase) and the soft segment component (S phase) will be described in detail below.

Glass Transition Temperature (Tg) of Polyurethane Member

The polyurethane member preferably has a glass transition temperature (Tg) of −30° C. or more and −5° C. or less, or about −30° C. or more and about −5° C. or less, more preferably −30° C. or more and −8° C. or less, or about −30° C. or more and about −8° C. or less, and still more preferably −30° C. or more and −10° C. or less, or about −30° C. or more and about −10° C. or less.

When the glass transition temperature is −5° C. or less or about −5° C. or less, the soft segment component (S phase) in the polyurethane has high molecular mobility, the cohesive force of the hard segment component (H phase) is obtained, and permanent deformation of the cleaning blade is reduced. When the glass transition temperature is −30° C. or more or about −30° C. or more, the domain of the hard segment component (H phase) is satisfactorily grown, and the strength necessary for the cleaning blade is obtained.

Herein, the glass transition temperature (Tg) of the polyurethane member is measured with a differential scanning calorimeter (DSC) from −80° C. to 150° C. at a temperature-increasing rate of 10° C./min by the method specified in ASTM D3418-82.

An example of a method for controlling the glass transition temperature (Tg) of the polyurethane member is a method for adjusting the polarities of the hard segment component (H phase) and the soft segment component (S phase). Specific methods thereof will be described below.

Hard Segment Component and Soft Segment Component in Polyurethane

The polyurethane in the cleaning blade according to the present exemplary embodiment contains a hard segment component (H phase) and a soft segment component (S phase). The polyurethane is a polymer obtained by polymerizing at least a polyol and a polyisocyanate. The polyol corresponds to the soft segment component (S phase), and the polyisocyanate corresponds to the hard segment component (H phase).

The polyurethane according to the present exemplary embodiment may be a polymer obtained by further polymerizing a chain-extending agent, a cross-linking agent, and the like in addition to the polyol and the polyisocyanate. In the case where at least one of a chain-extending agent and a cross-linking agent is contained as a polymerization component, the chain-extending agent and the cross-linking agent also correspond to the hard segment component (H phase).

The structure of a cleaning blade according to the present exemplary embodiment will now be described in detail.

Figure 2:
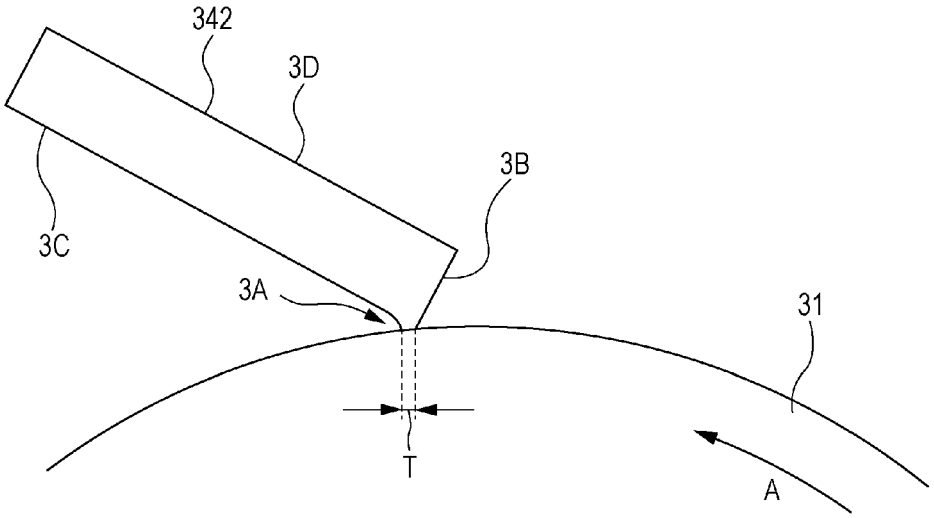
FIG. 2 is a schematic view illustrating a state in which a cleaning blade according to an exemplary embodiment is in contact with an image-carrying member which is driving.

As illustrated in FIG. 1, the cleaning blade according to the exemplary embodiment is arranged to be in contact with a surface of a member 31 to be cleaned. When the member 31 to be cleaned is driven, as illustrated in FIG. 2, sliding occurs in a contact portion where a cleaning blade 342 is in contact with the member 31 to be cleaned, and a nip part T is formed. Thus, the surface of the member 31 to be cleaned is cleaned.

Respective portions of the cleaning blade will now be described with reference to the drawings. In the description below, as illustrated in FIG. 1, the cleaning blade includes a contact corner portion 3A, an end surface 3B, a front surface 3C, and a back surface 3D. The contact corner portion 3A comes in contact with the member (image-carrying member, i.e., photoreceptor drum) 31 that is driven and that is to be cleaned and cleans the surface of the member (image-carrying member) 31 to be cleaned. The end surface 3B, one edge of which is formed by the contact corner portion 3A, faces the upstream side of a direction in which the member 31 is driven (direction shown by the arrow A). The front surface 3C, one edge of which is formed by the contact corner portion 3A, faces the downstream side of the direction in which the member 31 is driven (direction shown by the arrow A). The back surface 3D, one edge of which is shared with the end surface 3B, faces the front surface 3C.

A direction parallel to a direction in which the contact corner portion 3A comes in contact with the member 31 to be cleaned (direction from the front surface to the back surface of the paper of FIG. 1) is referred to as a "longitudinal direction". A direction extending from the contact corner portion 3A to the side on which the end surface 3B is formed is referred to as a "thickness direction". A direction extending from the contact corner portion 3A to the side on which the front surface 3C is formed is referred to as a "width direction".

In FIG. 1, for the sake of convenience, the direction in which the image-carrying member (photoreceptor drum) 31 is driven is shown by the arrow A. However, FIG. 1 illustrates a state where the image-carrying member 31 is stopped.

Figure 5:
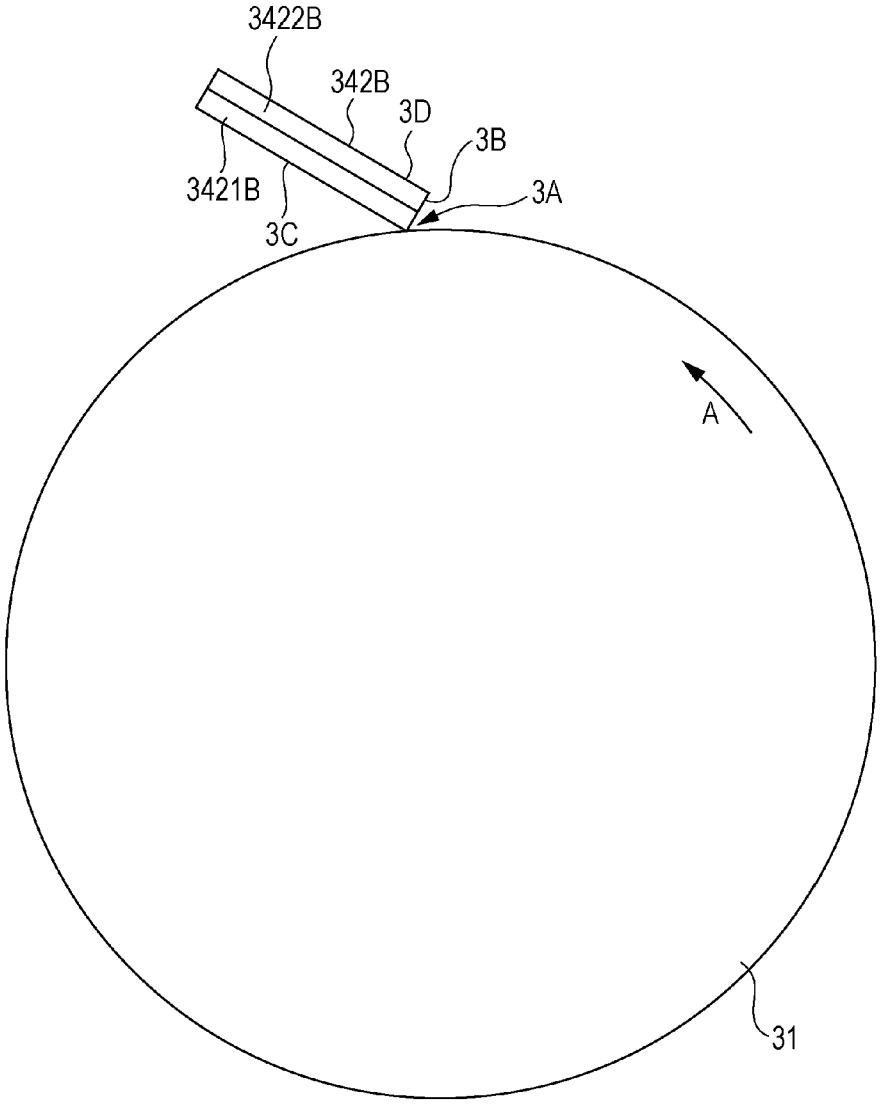
FIG. 5 is a schematic view illustrating another example of a cleaning blade according to an exemplary embodiment.
Figure 6:
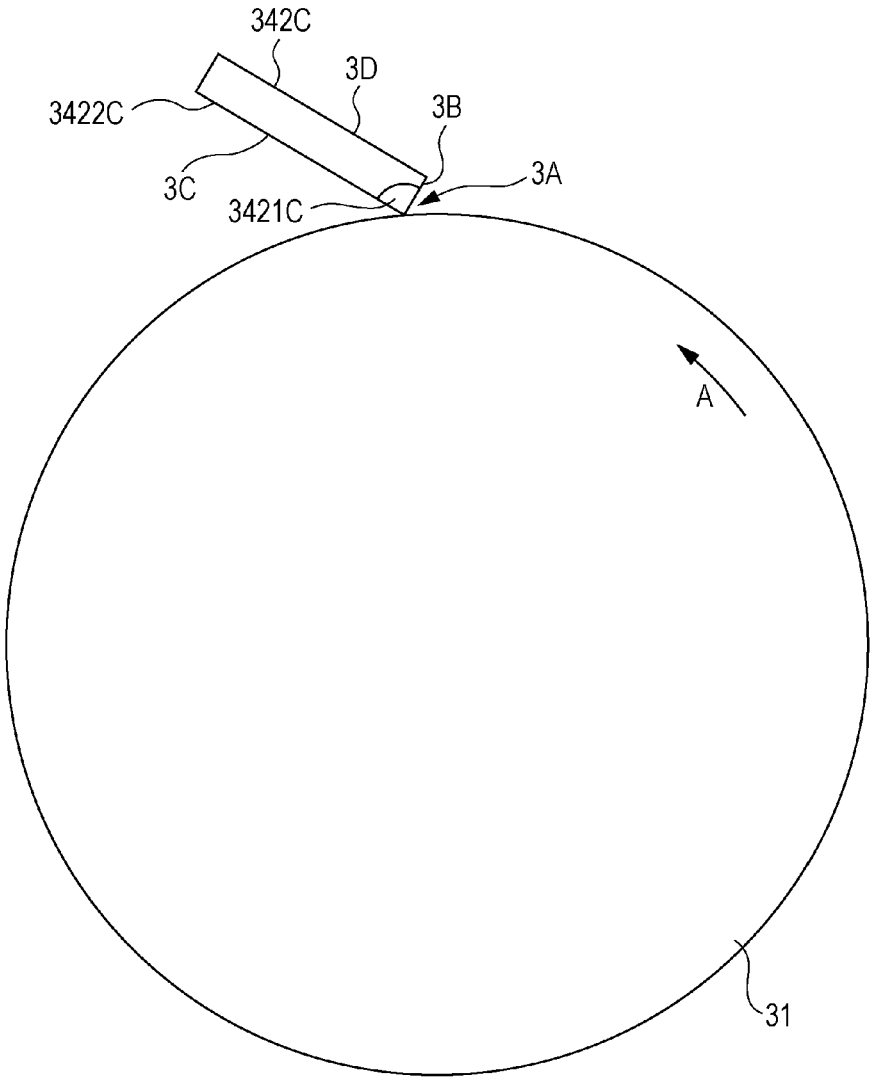
FIG. 6 is a schematic view illustrating another example of a cleaning blade according to an exemplary embodiment.

FIG. 1 is a schematic view illustrating a cleaning blade according to a first exemplary embodiment, and illustrates a state where the cleaning blade is in contact with a surface of a photoreceptor drum, which is an example of a member to be cleaned. FIG. 5 is a schematic view illustrating a state where a cleaning blade according to a second exemplary embodiment is in contact with a surface of a photoreceptor drum. FIG. 6 is a schematic view illustrating a state where a cleaning blade according to a third exemplary embodiment is in contact with a surface of a photoreceptor drum.

A cleaning blade 342A according to the first exemplary embodiment illustrated in FIG. 1 includes a polyurethane member alone. Specifically, the whole of the cleaning blade 342A including a portion (contact corner portion 3A) that comes in contact with a photoreceptor drum 31 is formed of a single material.

The cleaning blade according to the exemplary embodiment may have a two-layer structure as in the second exemplary embodiment illustrated in FIG. 5. Specifically, the cleaning blade may include a first layer 3421B and a second layer 3422B. The first layer 3421B includes a portion (contact corner portion 3A) which comes in contact with the photoreceptor drum 31, is formed over the entire surface on the front surface 3C side, and is formed of a polyurethane member. The second layer 3422B is formed on the back surface 3D side relative to the first layer 3421B, and functions as a back surface layer formed of a material different from a material of the polyurethane member.

The cleaning blade of the exemplary embodiment may have a structure as in the third exemplary embodiment illustrated in FIG. 6. Specifically, the cleaning blade may include a contact member (edge member) 3421C formed of a polyurethane member and a back surface member 3422C formed of a material different from a material of the polyurethane member. The contact member 3421C includes a portion (i.e., contact corner portion 3A) which comes in contact with the photoreceptor drum 31. The contact member 3421C has a shape in which a quarter-circle column extends in the longitudinal direction, and a right-angle portion of the shape forms the contact corner portion 3A of the contact member. The back surface member 3422C covers a portion on the back surface 3D side of the contact member 3421C in the thickness direction and a portion on the side opposite to the end surface 3B of the contact member 3421C in the width direction. That is, the back surface member 3422C constitutes a portion other than the contact member 3421C.

FIG. 6 illustrates, as the contact member, an example of a member having a shape of a quarter-circle column. However, the shape of the contact member is not limited thereto. Alternatively, the contact member may have a shape of a quarter-ellipse column, a square-cross-section prism, a rectangular-cross-section prism, or the like.

(Polyurethane Member)

The polyurethane member in the cleaning blade according to the present exemplary embodiment contains a polyurethane (polyurethane rubber). The polyurethane is synthesized by polymerizing at least a polyisocyanate and a polyol. Besides a polyol, a resin having a functional group that may react with an isocyanate group may be used. The polyurethane includes a hard segment component (H phase) and a soft segment component (S phase).

Herein, the term "hard segment component (H phase)" refers to a segment formed of a material harder than a material constituting the soft segment component (S phase) in a resin, and the term "soft segment component (S phase)" refers to a segment formed of a material softer than a material constituting the hard segment component (H phase) in the resin. In the exemplary embodiment, the polyol corresponds to the soft segment component (S phase), and the polyisocyanate corresponds to the hard segment component (H phase). The polyurethane according to the exemplary embodiment may be a polymer obtained by further polymerizing a chain-extending agent, a cross-linking agent, and the like in addition to the polyol and the polyisocyanate. In such a case, the chain-extending agent and the cross-linking agent also correspond to the hard segment component (H phase).

—Soft Segment Component—

Polyol

Examples of the material constituting the soft segment component (S phase) include polyols. Specific examples thereof include polyester polyols (such as polyester polyols obtained by dehydration condensation of a diol and a dibasic acid and polyester polyols obtained by ring-opening polymerization of a lactone (cyclic ester)), polyether polyols, polycarbonate polyols (such as polycarbonate polyols obtained by a reaction between a diol and an alkyl carbonate), and polycaprolactone polyols.

Examples of the diol used in the polymerization of a polyester polyol obtained by dehydration condensation of a diol and a dibasic acid include ethylene glycol, propanediol, butanediol, pentanediol, hexanediol, heptanediol, octanediol, nonanediol, decanediol, undecanediol, dodecanediol, tridecanediol, tetradecanediol, octadecanediol, and eicosanediol.

In particular, polyester polyols obtained by polymerizing a straight-chain diol having 9 or more carbon atoms (diol in which both ends of a carbon chain are substituted with two hydroxyl groups and the carbon chain between the two hydroxyl groups is a straight chain) are more preferable. The number of carbons is more preferably 9 or more and 12 or less and still more preferably 9 or more and 11 or less.

Examples of the dibasic acid used in the polymerization of a polyester polyol include adipate (adipic acid), oxalic acid, malonic acid, succinic acid, glutaric acid, pimelic acid, suberic acid, azelaic acid, sebacic acid, nonanedicarboxylic acid, decanedicarboxylic acid, undecanedicarboxylic acid, dodecanedicarboxylic acid, tridecanedicarboxylic acid, tetradecanedicarboxylic acid, hexadecanedicarboxylic acid, octadecanedicarboxylic acid, and lower alkyl esters and acid anhydrides thereof. Among these, succinic acid, adipic acid, and sebacic acid are preferable.

Examples of the lactone used in polymerization of a polyester polyol obtained by ring-opening polymerization of a lactone (cyclic ester) include ϵ-caprolactone, trimethylcaprolactone, and valerolactone. Among these, ϵ-caprolactone is preferable.

Examples of the polyester polyols includes a polyester polyol obtained by dehydration condensation of nonanediol and adipate (adipic acid), a polyester polyol obtained by dehydration condensation of decanediol and adipate (adipic acid), and a polyester polyol obtained by ring-opening polymerization of ϵ-caprolactone. In particular, polyester polyols obtained by polymerizing a straight-chain diol having 9 or more carbon atoms are more preferable. Specifically, polyester polyols obtained by dehydration condensation of a straight-chain diol having 9 or more carbon atoms and a dibasic acid are preferable.

Examples of the polyether polyols include polyalkylene glycols such as polyethylene glycol, polypropylene glycol, polytetramethylene ether glycol (PTMG), and copolymers thereof. Among these, polytetramethylene ether glycol is preferable. An example of a preferable polyether polyol is a polyether polyol obtained by cationic polymerization of tetrahydrofuran.

At least one polyol selected from polyether polyols and polyester polyols obtained by polymerizing at least a straight-chain diol having 9 or more carbon atoms is preferably used as the soft segment component. These may be used alone or in combination of two or more polyols.

An example of a method for controlling the domain particle size of the hard segment component (H phase) to the above range is a method for adjusting the polarities of the hard segment component (H phase) and the soft segment component (S phase).

An example of the method for adjusting the polarity of the soft segment component (S phase) is a method in which the material of the polyol used is selected. For example, in the case where a polyester polyol obtained by dehydration condensation of a diol and a dibasic acid is used as the polyol, the following properties are obtained. Specifically, with an increase in the length of the chain of the diol (with an increase in the number of carbon atoms between hydroxyl groups), the polarity of the soft segment component decreases, a phase separation from a high-polarity hard segment derived from a polyisocyanate proceeds, the domain particle size of the hard segment component (H phase) decreases, the glass transition temperature (Tg) also decreases, and plastic deformation decreases. In contrast, with a decrease in the length of the chain of the diol (with a decrease in the number of carbon atoms between hydroxyl groups), the polarity of the soft segment component increases, solubility with a high-polarity hard segment derived from a polyisocyanate increases and the soft segment is mixed in the hard segment, the domain particle size of the hard segment component (H phase) increases, the glass transition temperature (Tg) increases, and plastic deformation increases.

In the case where a polyester polyol obtained by ring-opening polymerization of a lactone (cyclic ester) is used as the polyol, the following properties are obtained. Specifically, with an increase in the number of carbon atoms forming the ring of the lactone, the polarity of the soft segment component decreases, the domain particle size of the hard segment component (H phase) decreases, and the glass transition temperature (Tg) also decreases. In contrast, with a decrease in the number of carbon atoms forming the ring of the lactone, the polarity of the soft segment component increases, the domain particle size of the hard segment component (H phase) increases, and the glass transition temperature (Tg) increases.

—Hard Segment Component—

Polyisocyanate

In the synthesis of the polyurethane, a polyisocyanate is used as the hard segment component. Examples of the polyisocyanate include 4,4'-diphenylmethane diisocyanate (MDI), 2,6-toluene diisocyanate (TDI), hexamethylene diisocyanate (HDI), 1,5-naphthalene diisocyanate (NDI), and 3,3'-dimethylbiphenyl-4,4-diisocyanate (TODI).

The polyisocyanate is preferably 4,4'-diphenylmethane diisocyanate (MDI), 1,5-naphthalene diisocyanate (NDI), and hexamethylene diisocyanate (HDI), and more preferably 4,4'-diphenylmethane diisocyanate (MDI).

The amount of polyisocyanate relative to 100 parts by weight of the resin having a functional group that may react with an isocyanate group of the polyisocyanate is preferably 20 parts by weight or more and 40 parts by weight or less, more preferably 20 parts by weight or more and 35 parts by weight or less, and still more preferably 20 parts by weight or more and 30 parts by weight or less. When the amount of polyisocyanate is 20 parts by weight or more, the urethane bond is ensured in a large amount and the hard segment is grown, and a desired hardness is obtained. When the amount of polyisocyanate is 40 parts by weight or less, the size of the hard segment does not excessively increase and expansibility is obtained, and thus the occurrence of chipping of the cleaning blade is suppressed.

Chain-Extending Agent

The polyurethane in the present exemplary embodiment may be a polymer in which a chain-extending agent serving as the hard segment component is polymerized.

The chain-extending agent is not particularly limited, and known chain-extending agent may be used. Examples of the chain-extending agent include glycols such as ethylene glycol, 1,3-propanediol, 1,4-butanediol, 1,5-pentanediol, 1,6-hexanediol, 1,7-heptanediol, 1,8-octanediol, 1,9-nonanediol, diethylene glycol, and neopentyl glycol; trivalent or higher polyhydric alcohols such as diglycerin and pentaerythritol; and amino polyhydric alcohols such as diisopropanolamine, triisopropanolamine, and triethanolamine. Among these, glycols and trivalent alcohols are preferable, and glycols are more preferable.

Among the glycols, straight-chain diols having 3 or more carbon atoms (diols in which both ends of a carbon chain are substituted with two hydroxyl groups and the carbon chain between the two hydroxyl groups is a straight chain) are preferable. The number of carbons is more preferably 3 or more and 5 or less, and still more preferably 3 or more and 4 or less. Specifically, 1,3-propanediol, 1,4-butanediol, 1,5-pentanediol, and 1,6-hexanediol are preferable.

A resin having a functional group that may react with an isocyanate group may be used as the chain-extending agent. The resin is preferably a resin having flexibility. From the viewpoint of flexibility, the resin is more preferably an aliphatic resin having a straight-chain structure. Specific examples of the resin include acrylic resins having two or more hydroxyl groups, polybutadiene resins having two or more hydroxyl groups, and epoxy resins having two or more epoxy groups.

Examples of commercially available products of the acrylic resins having two or more hydroxyl groups include ACTFLOW (grade: UMB-2005B, UMB-2005P, UMB-2005, UME-2005, etc.) manufactured by Soken Chemical & Engineering Co., Ltd.

An example of commercially available products of the polybutadiene resins having two or more hydroxyl groups is R-45HT manufactured by Idemitsu Kosan Co., Ltd.

The epoxy resins having two or more epoxy groups are not existing typical epoxy resins which are hard and brittle but are preferably epoxy resins which are more flexible and tougher than such existing epoxy resins. For example, from the viewpoint of the molecular structure, epoxy resins having a structure that may increase mobility of the main chain (flexible backbone) in the main chain structure thereof are suitable. Examples of the flexible backbone include alkylene backbones, cycloalkane backbones, and polyoxyalkylene backbones. In particular, polyoxyalkylene backbones are suitable. From the viewpoint of physical properties, epoxy resins having a low viscosity relative to a molecular weight as compared with existing typical epoxy resins are suitable. Specifically, the weight-average molecular weight is preferably in the range of 900±100, and the viscosity at 25° C. is preferably in the range of 15,000±5,000 mPa·s and more preferably in the range of 15,000±3,000 mPa·s. An example of commercially available products of an epoxy resin having these characteristics is EPICLON EXA-4850-150 manufactured by DIC Corporation.

The chain-extending agent is more preferably a straight-chain diol having three or more carbon atoms. The above compounds serving as the chain-extending agent may be used alone or in combination of two or more compounds.

The amount of chain-extending agent relative to 100 parts by weight of the resin having a functional group that may react with an isocyanate group is preferably 3 parts by weight or more and 50 parts by weight or less, and more preferably 5 parts by weight or more and 40 parts by weight or less.

Crosslinking Agent

The polyurethane in the present exemplary embodiment may be a polymer in which a crosslinking agent serving as the hard segment component is polymerized.

Examples of the crosslinking agent include diols (bifunctional crosslinking agents), triols (trifunctional crosslinking agents), and tetraols (tetrafunctional crosslinking agents). These may be used in combination. Alternatively, amine compounds may be used as the crosslinking agent. The polyurethane may be crosslinked by using a trifunctional or higher crosslinking agent. Examples of the trifunctional crosslinking agent include trimethylolpropane, glycerin, and triisopropanolamine.

The amount of crosslinking agent relative to 100 parts by weight of the resin having a functional group that may react with an isocyanate group is preferably 2 parts by weight or less. When the amount of crosslinking agent is 2 parts by weight or less, the hard segment derived from urethane bonds formed by aging is significantly grown without restriction of molecular motion due to chemical crosslinking, and thus a desired hardness is easily obtained.

In the polyurethane in the present exemplary embodiment, at least a polyisocyanate and a chain-extending agent are preferably used as the hard segment component. More preferably, diphenylmethane diisocyanate (MDI) is used as the polyisocyanate, and a straight-chain diol having 3 or more carbon atoms is used as the chain-extending agent.

An example of a method for controlling the domain particle size of the hard segment component (H phase) to the above range is a method for adjusting the polarities of the hard segment component (H phase) and the soft segment component (S phase).

Examples of the method for adjusting the polarity of the hard segment component (H phase) include selection of the material of the polyisocyanate, selection of the type of chain-extending agent, and adjustment of the mixing ratio of a polyisocyanate to a chain-extending agent when the polyisocyanate and the chain-extending agent are used. For example, by increasing the mixing ratio of the polyisocyanate (in particular, MDI), the polarity of the hard segment component increases, a phase separation from a soft segment proceeds, the domain particle size of the hard segment component (H phase) decreases, the glass transition temperature (Tg) also decreases, and plastic deformation decreases. In contrast, by decreasing the mixing ratio of the polyisocyanate (in particular, MDI), the polarity of the hard segment component decreases, solubility with a soft segment increases and the soft segment is mixed in the hard segment, the domain particle size of the hard segment component (H phase) increases, the glass transition temperature (Tg) increases, and plastic deformation increases.

Alternatively, in the case where a diol is used as the chain-extending agent, a method for adjusting the number of carbon atoms of the diol may be employed. By decreasing the number of carbon atoms of the diol, the polarity of the hard segment component increases, the domain particle size of the hard segment component (H phase) decreases, and the glass transition temperature (Tg) also decreases. In contrast, by increasing the number of carbon atoms of the diol, the polarity of the hard segment component decreases, the domain particle size of the hard segment component (H phase) increases, and the glass transition temperature (Tg) increases.

Content of Hard Segment Component

The weight ratio of the material constituting the hard segment to the total amount of the hard segment material and the soft segment material (hereinafter referred to as "hard segment material ratio") is preferably in a range of 20% by weight or more and 45% by weight or less, and more preferably 30% by weight or more and 40% by weight or less.

When the hard segment material ratio is 20% by weight or more, abrasion resistance is obtained, and a good cleaning property is maintained for a long time. When the hard segment material ratio is 45% by weight or less, the polyurethane does not become excessively hard, flexibility and expansibility are obtained, the occurrence of chipping is suppressed, and a good cleaning property is maintained for a long time.

Method for Forming Polyurethane Member (Contact Member)

In the production of a polyurethane constituting the polyurethane member (contact member) in the present exemplary embodiment, a typical method for producing a polyurethane, such as a prepolymer method or a one-shot method, is employed. The prepolymer method is suitable for the present exemplary embodiment because a polyurethane having high strength and good abrasion resistance is obtained. However, the polyurethane is not limited by the production method.

The polyurethane is produced by mixing a polyisocyanate, a chain-extending agent, a crosslinking agent, etc. with the polyol described above, and forming the resulting composition.

The contact member of the cleaning blade is prepared by, for example, forming a composition for forming a polyurethane member (contact member), the composition being prepared by the above method, into a sheet by using centrifugal molding, extrusion molding, or the like, and performing a cutting process or the like.

For example, a composition for forming a polyurethane member (contact member) is poured into a mold of a centrifugal molding machine, and is subjected to a curing reaction. The mold temperature at this time is preferably 80° C. or more and 160° C. or less, and more preferably 100° C. or more and 140° C. or less. The reaction time is preferably 20 minutes or more and 3 hours or less, and more preferably 30 minutes or more and 2 hour or less.

The resulting cured product is further heated for aging and cooled. The temperature during this heating for aging is preferably 70° C. or more and 130° C. or less, more preferably 80° C. or more and 130° C. or less, and still more preferably 100° C. or more and 120° C. or less. The reaction time is preferably 1 hour or more and 48 hours or less, and more preferably 10 hours or more and 24 hours or less.

100% Modulus (Stress at a Given Elongation)

The polyurethane member preferably has a 100% modulus of 6 MPa or more, more preferably 7 MPa or more, and still more preferably 7.5 MPa or more. Regarding the upper limit of the 100% modulus, the 100% modulus is preferably 11 MPa or less, and more preferably 10 MPa or less.

When the 100% modulus is 6 MPa or more, the polyurethane member has an appropriate hardness and good abrasion resistance.

Herein, the 100% modulus is a value measured in accordance with JIS K6251 (2004). Specifically, the measurement is performed using a dumbbell-shaped No. 3 test piece at a tensile speed of 500 mm/min to obtain a stress-strain curve (environmental temperature: 23° C.), and the 100% modulus is determined on the basis of this curve. A Strograph AE Elastomer manufactured by Toyo Seiki Seisaku-sho, Ltd. is used as a measurement device.

(Non-Contact Member)

A description will be made of a composition of a non-contact member in the case where the cleaning blade of the exemplary embodiment has a structure in which a contact member and a region other than the contact member (non-contact member) are formed of different materials, as in the second exemplary embodiment illustrated in FIG. 5 or the third exemplary embodiment illustrated in FIG. 6.

The material of the non-contact member in the cleaning blade according to the exemplary embodiment is not particularly limited, and any known material may be used.

Examples of the material used as the non-contact member include polyurethanes, silicone rubber, fluororubber, chloroprene rubber, and butadiene rubber. Among these materials, polyurethanes are preferable. Examples of the polyurethanes include ester-based polyurethanes and ether-based polyurethanes. In particular, ester-based polyurethanes are preferable.

An example of a method for producing a polyurethane is a method using a polyol and a polyisocyanate.

Examples of the polyol include polytetramethylene ether glycol (PTMG), polyethylene adipate, and polycaprolactone.

Examples of the polyisocyanate include 2,6-toluene diisocyanate (TDI), 4,4'-diphenylmethane diisocyanate (MDI), para-phenylene diisocyanate (PPDI), 1,5-naphthalene diisocyanate (NDI), and 3,3'-dimethylbiphenyl-4,4'-diisocyanate (TODI). Among these polyisocyanates, MDI is preferable.

Furthermore, examples of a curing agent for curing the polyurethane include 1,4-butanediol, trimethylolpropane, ethylene glycol, and mixtures thereof.

A specific example will be described. 4,4'-Diphenylmethane diisocyanate is mixed with polytetramethylene ether glycol which has been subjected to a dehydration treatment, and the resulting mixture is allowed to react to produce a prepolymer. 1,4-Butanediol and trimethylolpropane may be used in combination as a curing agent and added to the prepolymer. An additive such as a reaction-controlling agent may be added thereto.

A known method is employed as a method for preparing the non-contact member in accordance with the raw material used in the preparation. The non-contact member is prepared by, for example, forming the material by centrifugal molding, extrusion molding, or the like, and performing a cutting process or the like so as to have a predetermined shape.

(Production of Cleaning Blade)

In the case where a cleaning blade includes only the contact member illustrated in FIG. 1, the cleaning blade is produced by the above-described method for forming the contact member.

In the case where a cleaning blade has a multilayer structure, for example, the two-layer structure illustrated in FIG. 5, the cleaning blade is produced by bonding a first layer functioning as a contact member and a second layer (plural layers in the case of a structure including three or more layers) functioning as a non-contact member to each other. In the method for bonding the layers to each other, a double-sided tape, an adhesive, or the like is suitably used. Alternatively, plural layers may be bonded to each other by pouring materials of respective layers into a mold at time intervals during molding, thus joining the molded materials to each other without providing an adhesive layer.

In the case where a cleaning blade includes a contact member (edge member) and a non-contact member (back surface member) as illustrated in FIG. 6, the cleaning blade is produced as follows. A first mold and a second mold are prepared. The first mold has a cavity (i.e., a region into which a composition for forming a contact member is poured) corresponding to a semicircular column shape formed by arranging two contact members 3421C illustrated in FIG. 6 so that the front surfaces 3C of the contact members 3421C are in contact with each other. The second mold has a cavity corresponding to a shape formed by arranging two contact members 3421C and two non-contact members 3422C so that the front surfaces 3C of the contact members 3421C are in contact with each other and the front surfaces 3C of the non-contact members 3422C are in contact with each other. A composition for forming a contact member is poured into the cavity of the first mold and then cured to form a first molded body having a shape in which the two contact members 3421C are in contact with each other. Next, the first mold is detached. Subsequently, the second mold is disposed so that the first molded body is arranged inside the cavity of the second mold. A composition for forming a non-contact member is then poured into the cavity of the second mold so as to cover the first molded body and cured to form a second molded body having a shape in which the two contact members 3421C and the two non-contact members 3422C are arranged so that the front surfaces 3C of the contact members 3421C are in contact with each other and the front surfaces 3C of the non-contact members 3422C are in contact with each other. Subsequently, the resulting second molded body is cut at the center, that is, in a portion which is to form the front surface 3C. Specifically, the second molded body is cut such that the contact member having a semicircular column shape is separated at the center and each of the separated molded bodies has a shape of a quarter-circle column. The resulting molded body is further cut so as to have predetermined dimensions. Thus, the cleaning blade illustrated in FIG. 6 is produced.

Applications

In the case where a member to be cleaned is cleaned by using the cleaning blade of the exemplary embodiment, the member to be cleaned, which is a target of cleaning, is not particularly limited as long as cleaning of a surface of the member is required. For example, in the case where the cleaning blade is used in an image forming apparatus, examples of the member to be cleaned include an intermediate transfer body, a charging roller, a transfer roller, a transfer material-transporting belt, a paper transport roller, and a detoning roller that further removes a toner from a cleaning brush for removing the toner from an image-carrying member. In the exemplary embodiment, the member to be cleaned may be an image-carrying member.

Cleaning Device, Process Cartridge, and Image Forming Apparatus

A cleaning device, a process cartridge, and an image forming apparatus that include the cleaning blade of the present exemplary embodiment will be described.

The cleaning device of the exemplary embodiment is not particularly limited as long as the cleaning blade of the exemplary embodiment is provided as a cleaning blade that comes in contact with a surface of a member to be cleaned and that cleans the surface of the member. The cleaning device has, for example, the following structure. In a cleaning case having an opening adjacent to a member to be cleaned, a cleaning blade is fixed so that an end of an edge thereof is located on the opening side. The cleaning device includes a transport member that leads foreign substances such as a waste toner and the like to a foreign substance-collecting container, the waste toner and the like being collected by the cleaning blade from a surface of the member to be cleaned. The cleaning device of the exemplary embodiment may include two or more cleaning blades of the exemplary embodiment.

In the case where the cleaning blade of the exemplary embodiment is used for cleaning an image-carrying member, in order to suppress image deletion during image formation, a force NF (normal force) at which the cleaning blade is pressed onto the image-carrying member is preferably in the range of 1.3 gf/mm or more and 2.3 gf/mm or less, and more preferably in the range of 1.6 gf/mm or more and 2.0 gf/mm or less.

A length of an end of the cleaning blade engaged in the image-carrying member is preferably in the range of 0.8 mm or more and 1.2 mm or less, and more preferably in the range of 0.9 mm or more and 1.1 mm or less.

An angle W/A (working angle) in the portion in which the cleaning blade comes in contact with the image-carrying member is preferably in the range of 8° or more and 14° or less, and more preferably in the range of 10° or more and 12° or less.

The process cartridge of the exemplary embodiment is not particularly limited as long as the process cartridge includes the cleaning device of the exemplary embodiment as a cleaning device that comes in contact with a surface of at least one member to be cleaned, such as an image-carrying member and an intermediate transfer body, and that cleans the surface of the at least one member to be cleaned. For example, an exemplary embodiment of the process cartridge is detachably attachable to an image forming apparatus and includes an image-carrying member and the cleaning device of the exemplary embodiment that cleans the surface of the image-carrying member. For example, in the case of a so-called tandem machine that includes image-carrying members corresponding to toners of respective colors, the cleaning device of the exemplary embodiment may be provided for each of the image-carrying members. Besides the cleaning device of the exemplary embodiment, a cleaning brush and the like may be used in combination.

Specific Examples of Cleaning Blade, Image Forming Apparatus, and Cleaning Device Specific examples of the cleaning blade of the present exemplary embodiment, and an image forming apparatus and a cleaning device that include the cleaning blade will now be described in more detail with reference to the drawings.

Figure 3:
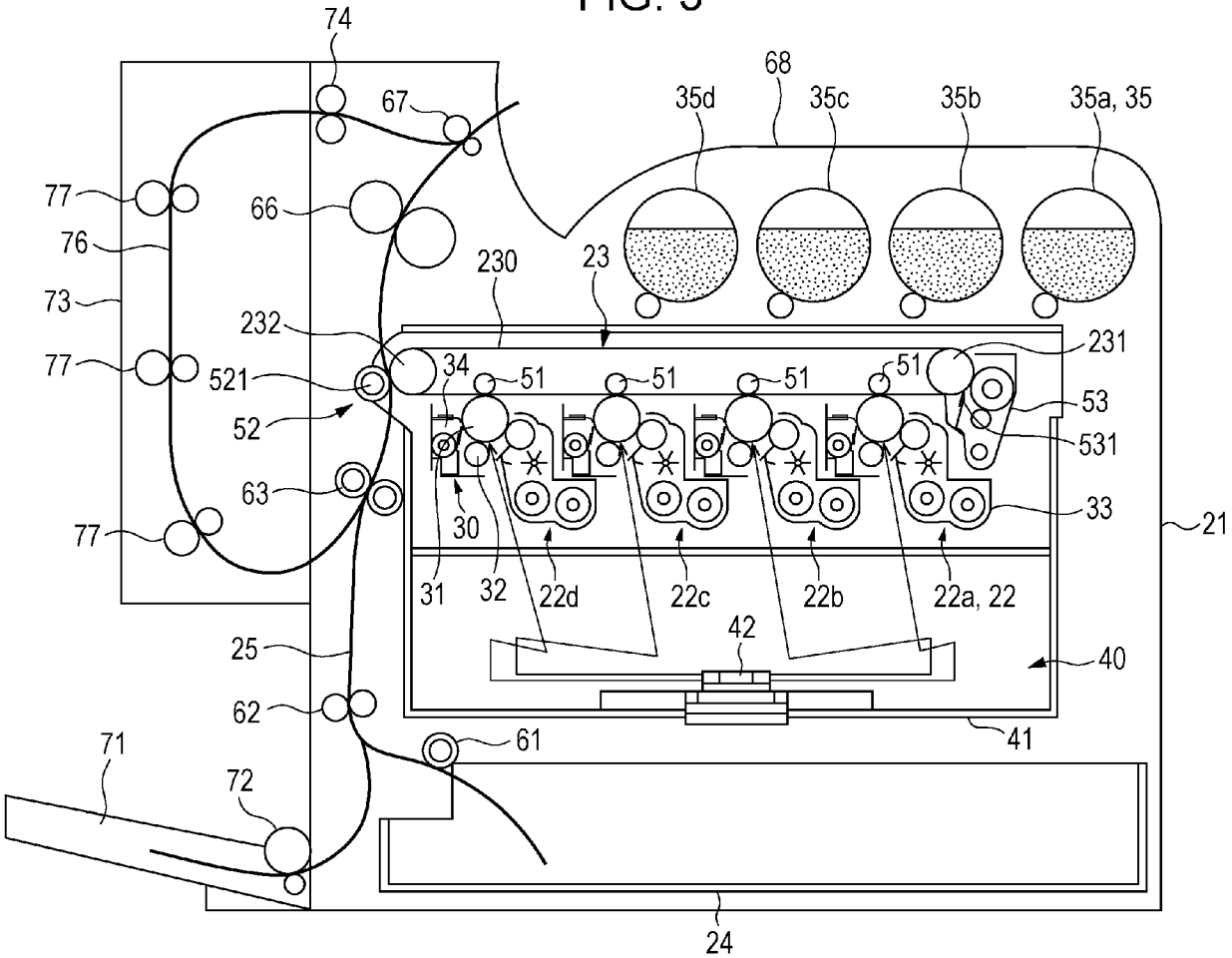
FIG. 3 is an overall schematic view illustrating an example of an image forming apparatus according to an exemplary embodiment.

FIG. 3 is an overall schematic view illustrating an example of an image forming apparatus according to the exemplary embodiment and illustrates a so-called tandem image forming apparatus.

The image forming apparatus illustrated in FIG. 3 includes a body housing 21, image forming units 22 (22*a* to 22*d*), a belt module 23, a recording medium supply cassette 24, a recording medium transport path 25, photoreceptor units 30, photoreceptor drums 31, charging rollers 32, developing units 33, cleaning devices 34, toner cartridges 35 (35*a* to 35*d*), an exposure unit 40, a unit case 41, a polygon mirror 42, first transfer devices 51, a second transfer device 52, a belt cleaning device 53, a feed roller 61, transport rollers 62, positioning rollers 63, a fixing device 66, discharge rollers 67, a paper discharge unit 68, a manual feeder 71, feed rollers 72, a double-side recording unit 73, guide rollers 74, a transport path 76, transport rollers 77, an intermediate transfer belt 230, support rollers 231 and 232, a second transfer roller 521, and a cleaning blade 531.

In the tandem image forming apparatus illustrated in FIG. 3, the image forming units 22 (specifically, 22*a* to 22*d*) of four colors (yellow, magenta, cyan, and black in this exemplary embodiment) are arranged in the body housing 21. Above the image forming units 22, the belt module 23 is arranged. The belt module 23 includes the intermediate transfer belt 230 which is transported in a circulating manner in a direction in which the image forming units 22 are arranged. In a lower portion of the body housing 21, the recording medium supply cassette 24 in which a recording medium (not illustrated) such as paper is housed is arranged, and the recording medium transport path 25, which serves as a transport path of the recording medium from the recording medium supply cassette 24, is arranged in the vertical direction.

In the exemplary embodiment, the image forming units 22 (22*a* to 22*d*) sequentially form toner images for yellow, magenta, cyan, and black (the arrangement of the image forming units 22 is not particularly limited to this order) from the upstream in a circulation direction of the intermediate transfer belt 230. The image forming units 22 (22*a* to 22*d*) each include a photoreceptor unit 30, a developing unit 33, and a common expose unit 40.

Each of the photoreceptor units 30 is produced by, for example, integrally arranging, as a sub-cartridge, a photoreceptor drum 31, a charging device (charging roller) 32 that charges the photoreceptor drum 31 in advance, and a cleaning device 34 that removes a toner remaining on the photoreceptor drum 31.

Each of the developing units 33 develops an electrostatic latent image, which is formed on the charged photoreceptor drum 31 by exposure with the exposure unit 40, with a corresponding color toner (for example, negative polarity in this exemplary embodiment). For example, each of the developing units 33 is integrated with the sub-cartridge including the photoreceptor unit 30 to form a process cartridge (so-called customer replaceable unit).

The photoreceptor unit 30 may be separated from the developing unit 33 and used alone as a process cartridge. In FIG. 3, the toner cartridges 35 (35*a* to 35*d*) supply respective color component toners to the corresponding developing units 33 (toner supply paths are not illustrated in the figure).

The exposure unit 40 includes, for example, four semiconductor lasers (not illustrated), the polygon mirror 42, imaging lenses (not illustrated), and mirrors (not illustrated) corresponding to the photoreceptor units 30 in the unit case 41. The exposure unit 40 is configured to deflect and scan light from the semiconductor laser for each color component by the polygon mirror 42 and to guide an optical image to an exposure point on the corresponding photoreceptor drum 31 through the imaging lens and the mirror.

In the exemplary embodiment, the belt module 23 includes, for example, a pair of the support rollers (one of which functions as a driving roller) 231 and 232, and the intermediate transfer belt 230 that is stretched between the support rollers 231 and 232. The first transfer devices (first transfer rollers in this exemplary embodiment) 51 are arranged at positions on the back surface of the intermediate transfer belt 230, the positions corresponding to the photoreceptor drums 31 of the respective photoreceptor units 30. By applying a voltage having a polarity opposite to the charging polarity of a toner to each of the first transfer devices 51, the toner image on the photoreceptor drum 31 is electrostatically transferred to the intermediate transfer belt 230. Furthermore, the second transfer device 52 is arranged in a portion corresponding to the support roller 232 on the downstream of the image forming unit 22*d* which is arranged on the most downstream side of the intermediate transfer belt 230. The second transfer device 52 performs a second transfer (collective transfer) of first transfer images formed on the intermediate transfer belt 230 to a recording medium.

In the exemplary embodiment, the second transfer device 52 includes the second transfer roller 521 which is arranged on the toner image carrying surface side of the intermediate transfer belt 230 under pressure, and a back surface roller (also used as the support roller 232 in this exemplary embodiment) which is arranged on the back surface side of the intermediate transfer belt 230 and which functions as a counter electrode of the second transfer roller 521. For example, the second transfer roller 521 is grounded, and a bias having the same polarity as the charging polarity of the toner is applied to the back surface roller (support roller 232).

The belt cleaning device 53 is further arranged on the upstream of the image forming unit 22*a* which is arranged on the most upstream side of the intermediate transfer belt 230. The belt cleaning device 53 removes the toner remaining on the intermediate transfer belt 230.

The feed roller 61 which feeds a recording medium is disposed on the recording medium supply cassette 24. The transport rollers 62 which feed the recording medium are arranged right behind the feed roller 61. The positioning rollers 63 which supply the recording medium to a second transfer portion at a predetermined timing are arranged on the recording medium transport path 25 which is located right in front of the second transfer portion. The fixing device 66 is arranged on the recording medium transport path 25 located on the downstream of the second transfer portion.

The discharge rollers 67 for discharging the recording medium are arranged on the downstream of the fixing device 66. The discharged recording medium is housed in the paper discharge unit 68 formed in an upper portion of the body housing 21.

In the exemplary embodiment, the manual feeder 71 is arranged on a side of the body housing 21. A recording medium on the manual feeder 71 is fed toward the recording medium transport path 25 through the feed rollers 72 and the transport rollers 62.

The double-side recording unit 73 is attached to the body housing 21. When a double-side mode, in which image recording is performed on two surfaces of a recording medium, is selected, the double-side recording unit 73 operates as follows. A recording medium in which recording has been performed on one surface thereof is introduced into the inner portion by reversely rotating the discharge rollers 67 and passing through the guide rollers 74 arranged in front of an inlet. The recording medium in the inner portion is transported through the transporting rollers 77 and along the transport path 76 for returning the recording medium, and supplied again to the positioning roller 63 side.

Next, the cleaning device 34 arranged in the tandem image forming apparatus illustrated in FIG. 3 will be described in detail.

Figure 4:
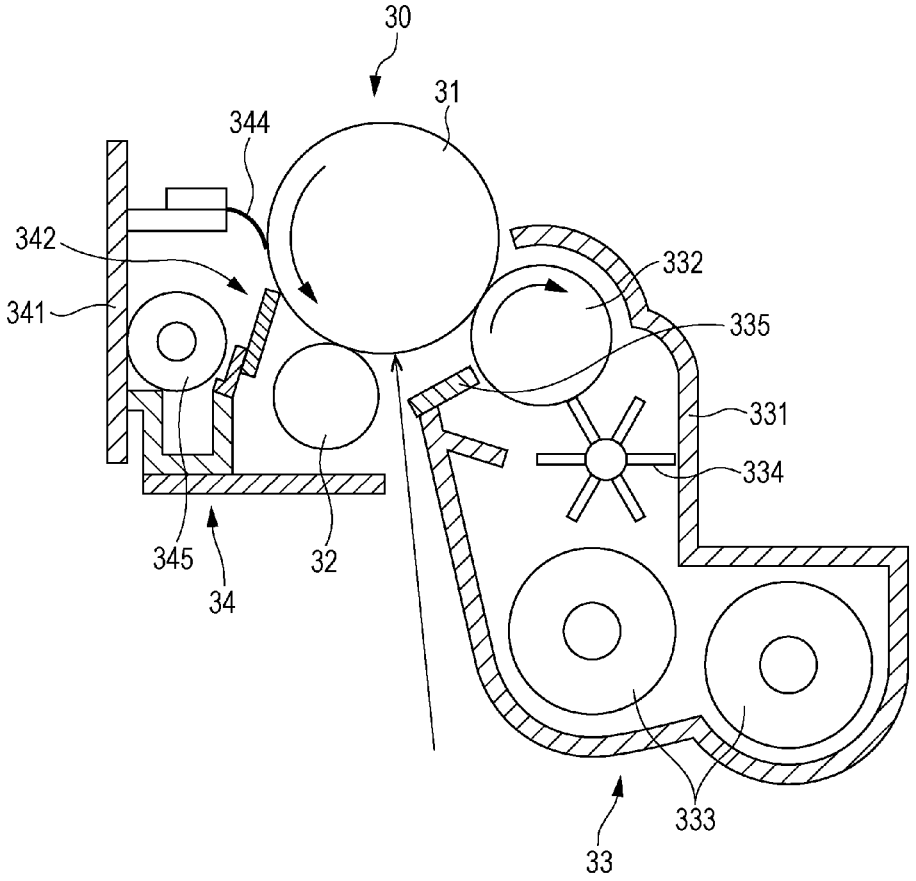
FIG. 4 is a schematic cross-sectional view illustrating an example of a cleaning device according to an exemplary embodiment.

FIG. 4 is a schematic cross-sectional view illustrating an example of the cleaning device of the exemplary embodiment. FIG. 4 also illustrates the photoreceptor drum 31 and the charging roller (charging device) 32 that form a sub-cartridge together with the cleaning device 34 illustrated in FIG. 3, and the developing unit 33.

In FIG. 4, the developing unit 33 includes a unit case 331, a developing roller 332, toner-transporting members 333, a transport paddle 334, and a developer quantity regulating member 335. The cleaning device 34 includes a cleaning case 341, a cleaning blade 342, a film seal 344, and a transport member 345.

The cleaning case 341 of the cleaning device 34 stores a remaining toner and is opened so as to face the photoreceptor drum 31. The cleaning blade 342 that is disposed to be in contact with the photoreceptor drum 31 is attached to a lower edge of the opening of the cleaning case 341 with a bracket (not illustrated) therebetween. The film seal 344 that keeps airtightness between the cleaning case 341 and the photoreceptor drum 31 is attached to an upper edge of the opening of the cleaning case 341. The transport member 345 guides a waste toner stored in the cleaning case 341 to a waste toner container provided on a side face.

In the exemplary embodiment, in all the cleaning devices 34 of respective image forming units 22 (22*a* to 22*d*), the cleaning blade of the exemplary embodiment may be used as the cleaning blade 342. In addition, the cleaning blade of the exemplary embodiment may be used as the cleaning blade 531 in the belt cleaning device 53.

As illustrated in FIG. 4, for example, the developing unit (developing device) 33 used in the exemplary embodiment includes the unit case 331 that stores a developer and is opened so as to face the photoreceptor drum 31. The developing roller 332 is arranged at a position facing the opening of the unit case 331. The toner-transporting members 333 for stirring and transporting the developer are arranged in the unit case 331. Furthermore, the transport paddle 334 may be arranged between the developing roller 332 and the toner-transporting members 333.

In the development, after the developer is supplied to the developing roller 332, the developer is transported to a developing area facing the photoreceptor drum 31 in a state where, for example, a layer thickness of the developer is regulated with the developer quantity regulating member 335.

In the exemplary embodiment, for example, a two-component developer containing a toner and a carrier is used in the developing unit 33. Alternatively, a one-component developer containing only a toner may be used.

Next, the operation of the image forming apparatus according to the present exemplary embodiment will be described. First, the respective image forming units 22 (22*a* to 22*d*) form single-color toner images corresponding to each color. The single-color toner images of each color are sequentially superimposed so as to match with original document information and subjected to a first transfer to a surface of the intermediate transfer belt 230. Subsequently, the color toner images transferred to the surface of the intermediate transfer belt 230 are transferred to a surface of a recording medium by the second transfer device 52. The recording medium to which the color toner images have been transferred is subjected to a fixing treatment by the fixing device 66, and then discharged to the paper discharge unit 68.

In the respective image forming units 22 (22*a* to 22*d*), the toner remaining on the photoreceptor drum 31 is cleaned by the cleaning device 34, and the toner remaining on the intermediate transfer belt 230 is cleaned by the belt cleaning device 53.

In this image forming process, each remaining toner is cleaned by the cleaning device 34 (or the belt cleaning device 53).

In the exemplary embodiment, the cleaning blade 342 is directly fixed to a frame member in the cleaning device 34 as illustrated in FIG. 4. Alternatively, the cleaning blade 342 may be fixed to a frame member with a spring material therebetween.

EXAMPLES

The invention will now be described using Examples, but the invention is not limited to the Examples.

Example 1

Preparation of Cleaning Blade A1

Prepolymerization of Polyol

Adipic acid (HOOC—$C_4H_8$—COOH) and nonanediol (HO—$C_8H_{18}$—OH) are polymerized in a molar ratio of 1:1, and a treatment is performed so that the polymerized product has terminal hydroxyl groups (—OH). A polyester polyol A1 is obtained in which a straight-chain diol having 9 carbon atoms (nonanediol) is polymerized. The polyester polyol A1 has a weight-average molecular weight of 2,000.

Formation of Cleaning Blade

A composition A1 for forming a cleaning blade is prepared by using the polyester polyol A1 as a soft segment component and propanediol (chain-extending agent), 4,4'-diphenylmethane diisocyanate (MDI, polyisocyanate, manufactured by Tosoh Corporation, Millionate MT), and trimethylolpropane (crosslinking agent, manufactured by Mitsubishi Gas Chemical Company, Inc.) as a hard segment component by allowing the soft segment component and the hard segment component to react with each other at 80° C. for two hours in a nitrogen atmosphere so that the amounts mixed are adjusted to the molar ratio shown in Table 1 below.

Next, the composition A1 for forming a cleaning blade is poured into a centrifugal molding machine including a mold whose temperature is adjusted to 140° C., and subjected to a curing reaction for one hour. Subsequently, the composition A1 is aged by heating at 110° C. for 24 hours and cooled. The resulting composition A1 is then cut to prepare a cleaning blade A1 having a width of 8 mm and a thickness of 2 mm.

Example 2

A composition for forming a cleaning blade is prepared by the method described in Example 1 except that the amounts of polyester polyol, chain-extending agent, polyisocyanate, and crosslinking agent mixed are changed as shown in Table 1 below, and a cleaning blade is obtained.

Example 3

Prepolymerization of Polyol

A polyester polyol A3 is obtained by subjecting C-caprolactone to ring-opening polymerization, and performing a treatment so that the polymerized product has terminal hydroxyl groups (—OH). The polyester polyol A3 has a weight-average molecular weight of 2,000.

A composition for forming a cleaning blade is prepared by the method described in Example 1 except that the polyester polyol A3 is used as the polyester polyol and that the types and the amounts of polyester polyol, chain-extending agent, polyisocyanate, and crosslinking agent mixed are changed as shown in Table 1 below, and a cleaning blade is obtained.

Example 4

Prepolymerization of Polyol

A polyether polyol A4 (PTMG) is obtained by cationically polymerizing tetrahydrofuran, and performing a treatment so that the polymerized product has terminal hydroxyl groups (—OH). The polyether polyol A4 has a weight-average molecular weight of 2,000.

A composition for forming a cleaning blade is prepared by the method described in Example 1 except that the polyether polyol A4 (PTMG) is used as a polyether polyol and that the types and the amounts of polyol, chain-extending agent, polyisocyanate, and crosslinking agent mixed are changed as shown in Table 1 below, and a cleaning blade is obtained.

Example 5

Prepolymerization of Polyol

Adipic acid (HOOC—$C_4H_8$—COOH) and butanediol (HO—$C_4H_8$—OH) are polymerized in a molar ratio of 1:1, and a treatment is performed so that the polymerized product has terminal hydroxyl groups (—OH). A polyester polyol A5 is obtained in which a straight-chain diol having 4 carbon atoms (butanediol) is polymerized. The polyester polyol A5 has a weight-average molecular weight of 2,000.

A composition for forming a cleaning blade is prepared by the method described in Example 1 except that the polyester polyol A5 is used as the polyester polyol and that the types and the amounts of polyester polyol, chain-extending agent, polyisocyanate, and crosslinking agent mixed are changed as shown in Table 1 below, and a cleaning blade is obtained.

Comparative Example 1

A composition for forming a cleaning blade is prepared by the method described in Example 1 except that the types and the amounts of composition used in prepolymerization of a polyol, polyol, chain-extending agent, polyisocyanate, and crosslinking agent mixed are changed as shown in Table 2 below, and a cleaning blade is obtained.

Comparative Example 2

A composition for forming a cleaning blade is prepared by the method described in Example 1 except that the types and the amounts of composition used in prepolymerization of a polyol, polyol, chain-extending agent, polyisocyanate, and crosslinking agent mixed are changed as shown in Table 2 below, and a cleaning blade is obtained.

Comparative Example 3

A composition for forming a cleaning blade is prepared by the method described in Example 1 except that the types and the amounts of composition used in prepolymerization of a polyol, polyol, chain-extending agent, polyisocyanate, and crosslinking agent mixed are changed as shown in Table 2 below, and a cleaning blade is obtained.

Measurement of Physical Property Values

The domain particle size of a hard segment component, the glass transition temperature (Tg) of a polyurethane member, and the 100% modulus of the polyurethane member are measured by the methods described above. Tables 1 and 2 below show the results.

Measurement of Amount of Edge Permanent Deformation

A process cartridge is prepared by attaching the cleaning blade of each of Examples and Comparative Examples to a surface of a photoreceptor (image-carrying member) so that the cleaning blade is engaged in contact with the surface. The process cartridge is left to stand for one week in a high-temperature high-humidity environment (45° C., 95% RH) in a constant-temperature constant-humidity chamber. The difference in amount of engagement of the cleaning blade between before and after the standing was defined as the amount of permanent deformation.

The amount of engagement is measured with a non-contact laser displacement gauge (manufactured by Keyence Corporation, product name: LK-035) that can measure the distance from the center of the photoreceptor to an end of an edge of the cleaning blade. Thus, the change in the amount of engagement is determined.

Image Evaluation (Structure of Image Forming Apparatus)

The cleaning blade of each of Examples and Comparative Examples is installed as a cleaning blade for a photoreceptor drum in an image forming apparatus (manufactured by Fuji Xerox Co., Ltd., product name: DocuCentre-II C7500) illustrated in FIG. 3.

Photoreceptor drum: organic photosensitive material (0=30 mm)

Process speed: 250 mm/sec

Charging device: Charging roll with alternating current-superimposed direct current Developing device: two-component magnetic brush developing device Cleaning blade: width 8 mm, thickness 2 mm, free length 7.0 mm, contact angle 25 degrees, pressing force (normal force NF) 2.0 gf/mm A test is performed using a toner (toner prepared by a polymerization method, having a shape factor distributed in a range of 123 to 128, and having an average particle size of 6 μm). A two-component developer containing this toner is housed in a developer container in the image forming apparatus and used. An image of a test printing (area ratio per color: 5%) is formed on 50,000 sheets by repeating 5-sheet printing using this image forming apparatus in each of environments described below. The test is performed in stress environments of a high-temperature high-humidity environment (32.5° C., 85% RH), a low-temperature low-humidity environment (5° C., 15% RH), and a middle-temperature middle-humidity environment (22° C., 55% RH) at a process speed of 250 mm/sec.

—Abrasion Resistance Evaluation—

Abrasion resistance of a cleaning blade is evaluated by a method described below.

The image is formed on A4 sheets (210×297 mm, P paper, manufactured by Fuji Xerox Co., Ltd.) in the high-temperature high-humidity environment (32.5° C., 85% RH) until the cumulative number of rotations of the photoreceptor becomes 100K cycles (100,000 rotations). After the image formation, an abrasion depth of an end of a contact portion (edge) of the cleaning blade and defective cleaning are evaluated in combination, and edge abrasion is thus determined. In this test, an image density (image density determined by the number of dots per unit area) of the image to be formed is set to 1% so that the evaluation is performed under a severe condition in which a lubricating effect in the contact portion between the photoreceptor and the cleaning blade is reduced. The abrasion depth of the end of the edge is defined as a maximum depth of an edge-missing portion of the cleaning blade on the photoreceptor surface side, the maximum depth being determined when the cleaning blade is observed from the cross-sectional side thereof with a laser microscope VK-8510 manufactured by Keyence Corporation.

The evaluation criteria of the edge abrasion are described below. The acceptable ranges are A and B.

A: Abrasion depth of end: The abrasion depth is 3 μm or less, and no abrasion trace is observed.

Defective cleaning: Not occur

B: Abrasion depth of end: The abrasion depth is more than 3 μm and 5 μm or less.

Defective cleaning: Not occur

C: Abrasion depth of end: The abrasion depth is more than 5 μm.

Defective cleaning: Occur

—Image Quality Evaluation—

The cleaning blade of each of Examples and Comparative Examples is installed as a cleaning blade for a photoreceptor drum in a color copying machine (manufactured by Fuji Xerox Co., Ltd., product name: DocuCentre Color a450).

An image having an image density (image density determined by the size of dots) of 1% (a solid image of 6.2 mm×1 mm on A4 size paper) is repeatedly formed using this color copying machine on 2,000 sheets (C2r paper, manufactured by Fuji Xerox Co., Ltd.). After the image formation, the state of occurrence of color-streak image quality defects is evaluated by visual observation on the basis of criteria described below.

A: No color streak is observed.

B: Color streaks are slightly observed on the image but are in an acceptable range.

C: Color streaks are observed on the image and are not acceptable.

TABLE 1

| | | Example 1 | Example 2 | Example 3 | Example 4 | Example 5 |
|---|---|---|---|---|---|---|
| Polyol | Material 1 | Adipic acid | Adipic acid | ε-Caprolactone | PTMG | Adipic acid |
| | Material 2 | Nonanediol | Nonanediol | — | — | Butanediol |
| | Amount mixed (mol %) | 65.8 | 68.3 | 70.8 | 81.3 | 69 |
| Chain-extending agent | Material | Propanediol | Propanediol | Butanediol | Butanediol | Propanediol |
| | Amount mixed (mol %) | 7.0 | 11 | 11 | 5 | 10.3 |
| Polyisocyanate | Material | MDI | MDI | MDI | MDI | MDI |
| | Amount mixed (mol %) | 26.5 | 20 | 17.5 | 13 | 20 |
| Crosslinking agent | Material | Trimethylolpropane | Trimethylolpropane | Trimethylolpropane | Trimethylolpropane | Trimethylolpropane |
| | Amount mixed (mol %) | 0.7 | 0.7 | 0.7 | 0.7 | 0.7 |
| Glass transition temperature (Tg) (° C.) | | −30 | −5 | −15 | −13 | −5 |
| Hard segment component domain particle size (nm) | | 50 | 100 | 50 | 70 | 100 |
| Modulus (MPa) | | 5.5 | 7.5 | 7.0 | 5 | 7.3 |
| Amount of edge permanent deformation (μm) | | 1.0 | 2.0 | 1.5 | 1.7 | 2.1 |
| Abrasion resistance | | A | A | A | A | A |
| Image quality | | A | A | A | A | A |

TABLE 2

| | | Comparative Example 1 | Comparative Example 2 | Comparative Example 3 |
|---|---|---|---|---|
| Polyol | Material 1 | Adipic acid | Adipic acid | Adipic acid |
| | Material 2 | Nonanediol | Butanediol | Butanediol |
| | Amount mixed (mol %) | 65.3 | 67.3 | 69.3 |
| Chain-extending agent | Material | Propanediol | Propanediol | Butanediol |
| | Amount mixed (mol %) | 6.0 | 16 | 17 |
| Polyisocyanate | Material | MDI | MDI | MDI |
| | Amount mixed (mol %) | 28.0 | 16.0 | 13.4 |
| Crosslinking agent | Material | Trimethylolpropane | Trimethylolpropane | Trimethylolpropane |
| | Amount mixed (mol %) | 0.7 | 0.7 | 0.3 |
| Glass transition temperature (Tg) (° C.) | | −33 | 0 | −2 |
| Hard segment component domain particle size (nm) | | 40 | 150 | 110 |
| Modulus (MPa) | | 5.0 | 7.0 | 6.5 |
| Amount of edge permanent deformation (μm) | | 0.8 | 3 | 2.7 |
| Abrasion resistance | | C | C | C |
| Image quality | | C | C | C |

In Examples, cleaning blades whose permanent deformation is small, which achieve good cleaning properties for a long time, and which provide good image performance are obtained by using polyurethane members that contain a hard segment component having a domain particle size of 45 nm or more and 100 nm or less and that have a glass transition temperature (Tg) of −30° C. or more and −5° C. or less.

In Comparative Example 1, the domain particle size of the hard segment component is less than 45 nm, and the glass transition temperature (Tg) is less than −30° C. Accordingly, abrasion resistance degrades and good images are not obtained.

In Comparative Examples 2 and 3, the domain particle size of the hard segment component exceeds 100 nm, and the glass transition temperature (Tg) exceeds −5° C. Accordingly, the permanent deformation is large, and good images are not obtained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade comprising:

a polyurethane member that constitutes at least a contact portion that comes in contact with a member to be cleaned, wherein the polyurethane member contains a polyurethane containing a hard segment component and a soft segment component, and the hard segment component has a domain particle size of about 45 nm or more and about 100 nm or less.

2. The cleaning blade according to claim 1, wherein the hard segment component has a domain particle size of about 45 nm or more and about 90 nm or less.

3. The cleaning blade according to claim 1, wherein the hard segment component has a domain particle size of about 45 nm or more and about 80 nm or less.

4. The cleaning blade according to claim 1, wherein the polyurethane member has a glass transition temperature (Tg) of about −30° C. or more and about −5° C. or less.

5. The cleaning blade according to claim 1, wherein the polyurethane member has a glass transition temperature (Tg) of about −30° C. or more and about −8° C. or less.

6. The cleaning blade according to claim 1, wherein the polyurethane member has a glass transition temperature (Tg) of about −30° C. or more and about −10° C. or less.

7. The cleaning blade according to claim 1, wherein the polyurethane is a resin in which at least diphenylmethane diisocyanate (MDI) and a straight-chain diol having 3 or more carbon atoms are polymerized, the MDI and the straight-chain diol serving as the hard segment component.

8. The cleaning blade according to claim 1, wherein the polyurethane is a resin in which at least one polyol selected from the group consisting of a polyether polyol and a polyester polyol that is obtained by polymerizing at least a straight-chain diol having 9 or more carbon atoms are polymerized, the at least one polyol serving as the soft segment component.

9. A process cartridge detachably attachable to an image forming apparatus, the process cartridge comprising:

a cleaning device that includes the cleaning blade according to claim 1.

10. An image forming apparatus comprising:

an image-carrying member;

a charging device that charges a surface of the image-carrying member;

an electrostatic latent image-forming device that forms an electrostatic latent image on the surface of the image-carrying member in a charged state;

a developing device that develops the electrostatic latent image formed on the surface of the image-carrying member with a developer containing a toner to form a toner image;

a transfer device that transfers the toner image to a surface of a recording medium; and a cleaning device that includes the cleaning blade according to claim 1 and that cleans the surface of the image-carrying member by bringing the cleaning blade into contact with the image-carrying member.

* * * * *